US006581418B1

(12) United States Patent
Kim

(10) Patent No.: US 6,581,418 B1
(45) Date of Patent: Jun. 24, 2003

(54) POLYCHROMATIC YARN DYEING APPARATUS

(76) Inventor: Cheoul-seouk Kim, Sanho Apt. #E-111, 118-16, Wonhyoro 4-ga, Yongsan-ku, Seoul (KR)

( * ) Notice: Subject to any disclaimer, the term of this patent is extended or adjusted under 35 U.S.C. 154(b) by 0 days.

(21) Appl. No.: 09/743,189

(22) PCT Filed: May 6, 2000

(86) PCT No.: PCT/KR99/00429

§ 371 (c)(1),
(2), (4) Date: Mar. 15, 2001

(87) PCT Pub. No.: WO00/68485

PCT Pub. Date: Nov. 16, 2000

(30) Foreign Application Priority Data

May 8, 1999 (KR) ..... 99-16477

(51) Int. Cl.[7] ..... D06B 1/10
(52) U.S. Cl. ..... 68/200; 68/202; 118/227
(58) Field of Search ..... 68/200, 202, 203; 110/111, 120; 118/216, 227, 223, 226, 234, 257, 263

(56) References Cited

U.S. PATENT DOCUMENTS

| | | | | |
|---|---|---|---|---|
| 1,792,788 | A | * | 2/1931 | Wilde et al. |
| 1,928,235 | A | * | 9/1933 | Taylor |
| 1,930,986 | A | * | 10/1933 | Shaffner |
| 2,176,393 | A | * | 10/1939 | Edge |
| 2,637,658 | A | * | 5/1953 | Miller |
| 2,868,162 | A | * | 1/1959 | Knain |
| 3,025,585 | A | * | 3/1962 | Griswold |
| 3,067,718 | A | * | 12/1962 | Kraft |
| 3,083,683 | A | * | 4/1963 | Fischer et al. |
| 3,589,926 | A | * | 6/1971 | Eckert et al. |
| 3,592,585 | A | * | 7/1971 | Candor et al. |
| 3,695,223 | A | * | 10/1972 | Dunham et al. |
| 3,783,654 | A | * | 1/1974 | Crawford |
| 3,803,880 | A | | 4/1974 | Laing et al. |
| 3,809,576 | A | * | 5/1974 | Marbach et al. |
| 3,866,566 | A | * | 2/1975 | Jones |
| 4,123,921 | A | * | 11/1978 | Eakes |
| 4,165,547 | A | * | 8/1979 | Parlin et al. |
| 4,305,169 | A | * | 12/1981 | Vidalis |
| 4,932,092 | A | * | 6/1990 | Yoshida |
| 5,168,731 | A | * | 12/1992 | Vidalis |
| 5,339,658 | A | | 8/1994 | Haselwander |
| 5,628,826 | A | * | 5/1997 | Prasad |

FOREIGN PATENT DOCUMENTS

| | | | |
|---|---|---|---|
| DE | 3146828 | * | 6/1983 |
| JP | 61-231279 | | 10/1986 |
| JP | 5-228933 | * | 9/1993 |
| KR | 97-0000313 | | 1/1997 |

* cited by examiner

*Primary Examiner*—Frankie L. Stinson
(74) *Attorney, Agent, or Firm*—Larson & Taylor PLC

(57) ABSTRACT

Disclosed is a polychromatic yam dyeing apparatus, comprising an upper track portion having at least one pair of upper wheels disposed in parallel, an upper caterpillar unit rotatably travelling around the upper wheels and a plurality of upper dyeing members coupled with the upper caterpillar unit, a lower track portion having at least one pair of lower wheels disposed in parallel, a lower caterpillar unit rotatably travelling around the lower wheels at the same travelling speed as that of the upper caterpillar unit and having a travelling section parallel to a travelling section of the upper caterpillar unit and a plurality of lower dyeing members coupled with the lower caterpillar unit and contacting the upper dyeing members, with a yarn being positioned therebetween, and a plurality of dye supplying parts disposed sequentially along the travelling direction of the lower caterpillar unit, for supplying dyestuff of different colors respectively to the lower dyeing members. With this construction, the polychromatic yarn dyeing apparatus decreases a space for installation and conducts continuous and repetitive dyeing operations with a unit pattern having unique color, width and arrangement

23 Claims, 10 Drawing Sheets

POLYCHROMATIC YARN DYEING APPARATUS

TECHNICAL FIELD

The present invention relates to yam dyeing apparatuses, and more particularly, to a polychromatic yarn dyeing apparatus wherein yams can be dyed polychromically through continuous and repetitive operations thereof.

BACKGROUND ART

In conventional yarn dyeing processes, yams, raw cottons or raw wools are at first dyed monochromically, and the dyed yams, cottons or wools are then combined with each other, thereby producing polychromatic yams, cottons or wools. Recently, a method of directly spraying dyestuff into each strand of yarns and a train of yam dyeing apparatus have been introduced to produce polychromatic yarns having a unique color.

However, the resulting color by the conventional process and apparatus has low vividness and clearness. In addition, the dye-spraying method has usually caused dye to be scattered in the air or colors to be overlapped, for which the products are of poor quality. In the dye-spraying method, the sprayed dye is likely to induce air pollution by being mixed with the air. In the dyeing apparatus train, its arrangement is complicated, thereby creating a difficulty in installation, requiring a large installation space, and increasing the cost of production.

DISCLOSURE OF THE INVENTION

Accordingly, to solve the problems as described above, it is an object of the present invention to provide a polychronmatic yam dyeing apparatus wherein yams can be dyed continuously along the advancing direction of the yarns with a desired pattern while decreasing the difficulty in installation and minimizing the installation space.

To accomplish the above-described object of the invention, there is provided a polychromatic yarn dying apparatus, comprising an upper track portion having at least one pair of upper wheels disposed in parallel, an upper caterpillar unit rotatably travelling around the upper wheels and a plurality of upper dyeing members coupled with the upper caterpillar unit, a lower track portion having at least one pair of lower wheels disposed in parallel, a lower caterpillar unit rotatably travelling around the lower wheels at the same travelling speed as that of the upper caterpillar unit and having a travelling section parallel to a travelling section of the upper caterpillar unit, and a plurality of lower dyeing members coupled with the lower caterpillar unit and contacting the upper dyeing members, with a yarn being positioned therebetween and a plurality of dye supplying parts disposed sequentially along the travelling direction of the lower caterpillar unit, for supplying dyestuff of different colors respectively to the lower dyeing members.

Desirably, the polychromatic yarn dyeing apparatus further comprises an elevating unit for elevating the lower dyeing members toward the corresponding dye supplying parts so as to contact the lower dyeing members with the dyestuff in the respective dye supplying parts.

Effectively, the elevating unit comprises a lower dyeing member support for supporting each of the lower dying members, a plurality of press members provided inside a lower section of the lower caterpillar unit along the advancing direction of the lower caterpillar unit in correspondence to the respective dye supplying parts, a press roller protruding from each of the lower dyeing member for contacting the press members to press the lower dyeing members against the press members, and a spring disposed between each lower dyeing member support and each lower dyeing member, for elastically recovering the pressed lower dyeing member to the original state.

Preferably, the polychromatic yarn dyeing apparatus further comprises an oscillating unit for oscillating the upper dyeing members in the transverse direction relative to the advancing direction of the upper caterpillar unit.

Effectively, the oscillating unit comprises an upper dyeing member support for supporting the upper dyeing members, an oscillation guide part forming a passage of S-type inside a lower section of the upper caterpillar unit along the advancing direction of the upper caterpillar unit and a sliding part protruding from each upper dyeing.member and slidably guided by the oscillation guide part.

Effectively, each of the dye supplying parts comprises a dye reservoir for containing the dyestuff, a dye belt forming a closed loop and having a portion dipped in the dye reservoir to contact the dyestuff and an upper section contacting with the lower caterpillar unit, and a dye belt driving unit for driving the dye belt to be rotated in the opposite direction to the lower caterpillar unit.

Preferably, the polychromatic yarn dyeing apparatus further comprises a dye belt vibrating unit for vibrating the dye belt to the vertical direction relative to the advancing direction of the dye belt.

Effectively, the polychromatic yarn dyeing apparatus further comprises a dye controlling unit in contact with a portion of the dye belt ascending out of the dye reservoir for controlling the amount of dyestuff absorbed in the dye belt.

Preferably, the polychromatic yam dyeing apparatus further comprises an agitating unit for agitating the dyestuff contained within the dye reservoir

BRIEF DESCRIPTION OF DRAWINGS

The above and other objects, features and other advantages of the present invention will be more clearly understood from the following detailed description taken in conjunction with the accompanying drawings, in which.

MODES FOR CARRYING OUT THE INVENTION

The preferred embodiments of the present invention will hereinafter be described with reference to FIGS. 1 to 18.

Figure 1:
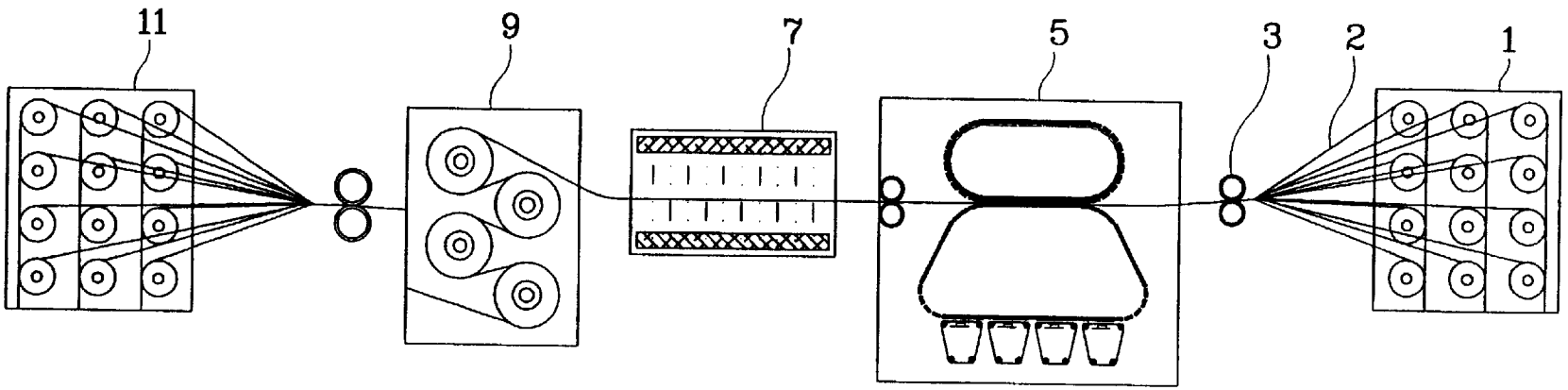
FIG. 1 shows a process of producing mixed color dyed yarns by a polychromatic yam: dyeing apparatus according to one embodiment of the present invention.
Figure 2:
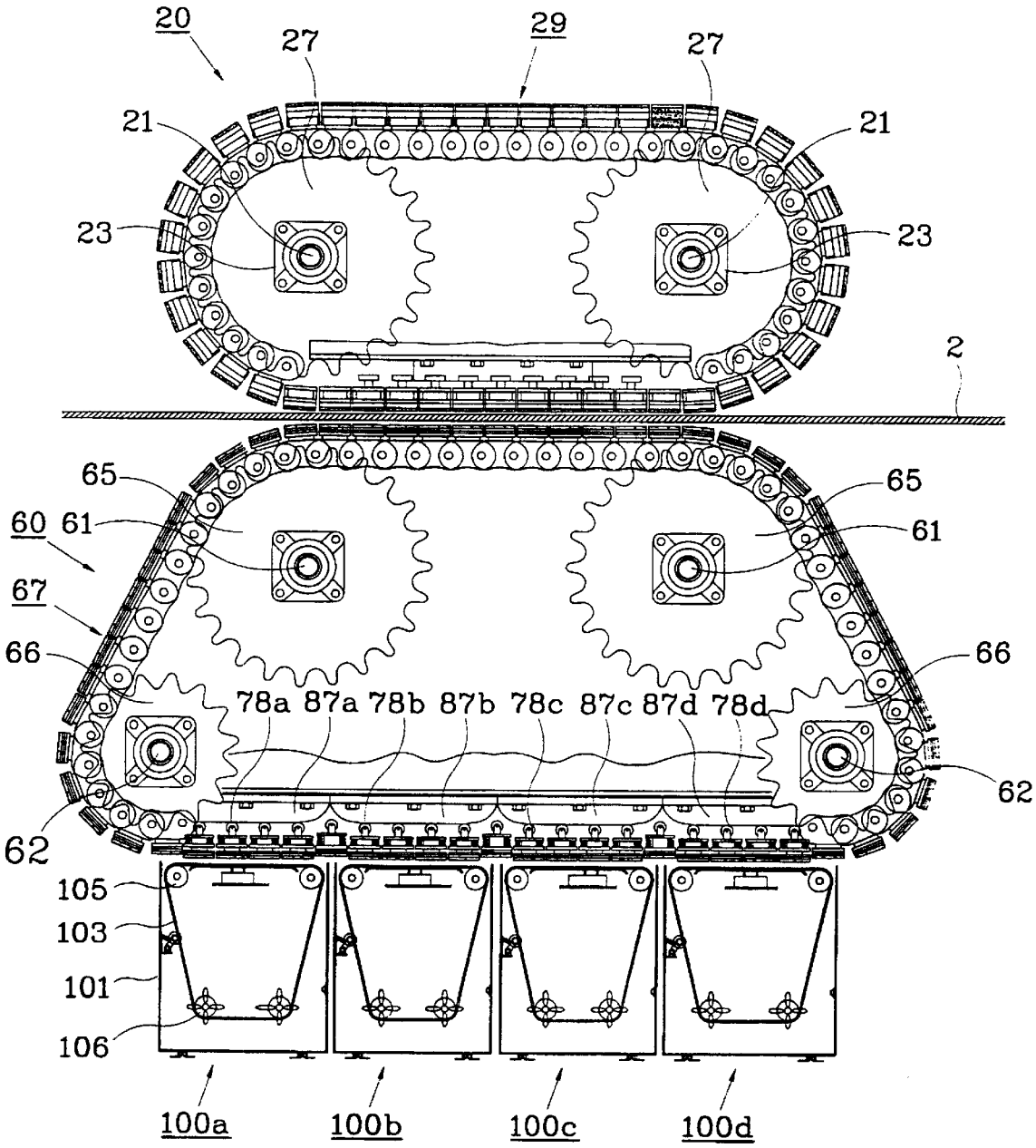
FIG. 2 is a side sectional view of the polychromatic yam dyeing apparatus according to one embodiment of the present invention.
Figure 3:
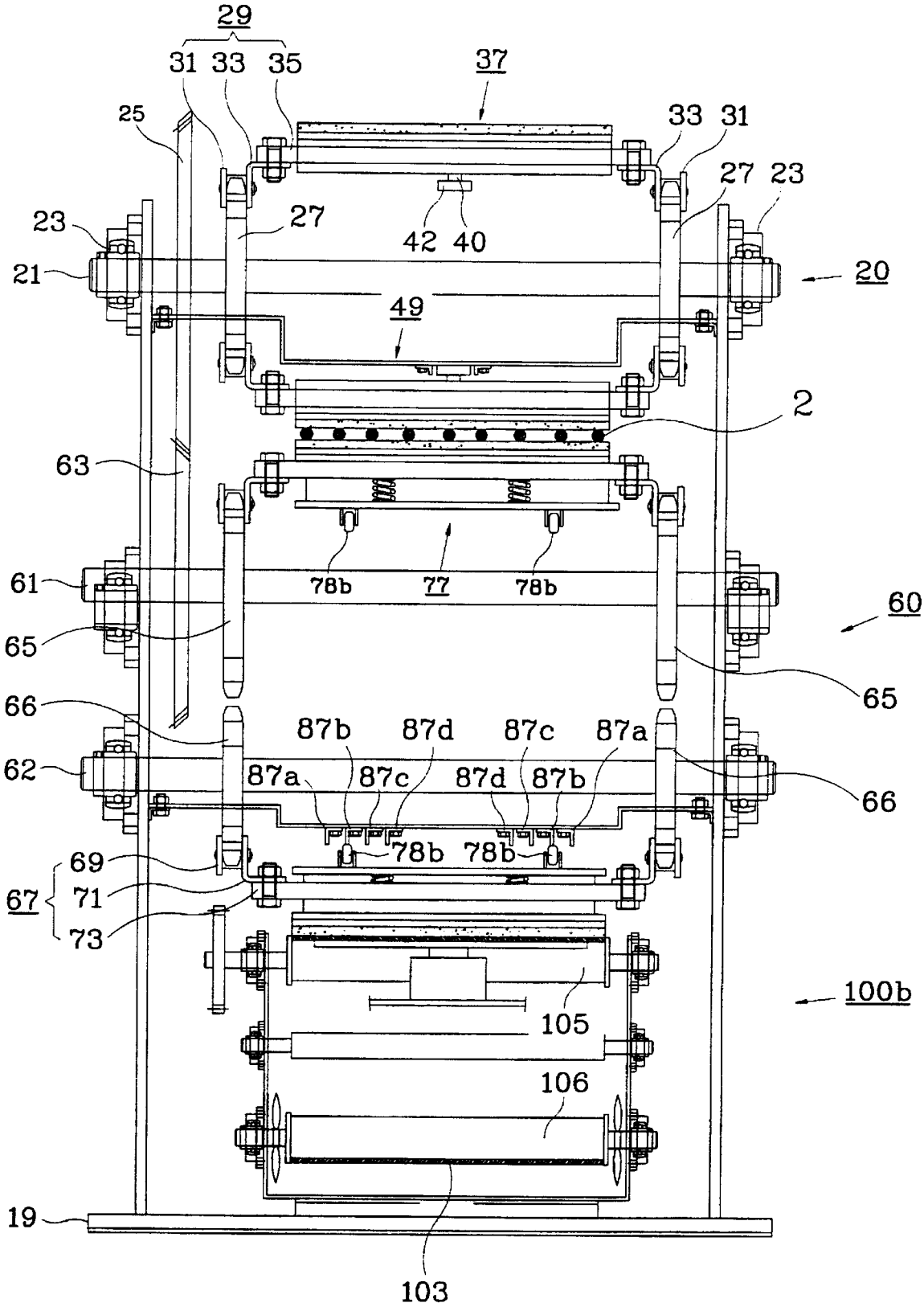
FIG. 3 is a sectional view of the polychromatic yam dyeing apparatus of FIG. 2.

FIG. 1 shows a process of producing mixed color dyed yarns by the polychromatic yarn dyeing apparatus according to one embodiment of the present invention. As illustrated, yarns 2 to be dyed are supplied to the polychromatic yarn dyeing apparatus from a raw yarn supplying device 1 by way of a supplying roller 3. Then, the supplied yarns 2 are dyed continuously with a unit pattern having desired colors for desired widths and arrangements by the polychromatic yarn dyeing apparatus. The dyed yarns 2 are then dried by passing through a drier 7 and a drying setting device 9 and then wound up by a take-up device 11. FIG. 2 is a side sectional view of the polychromatic yam dyeing apparatus 5 according to one embodiment of the present invention, and FIG. 3 is a sectional view of the polychromatic yarn dyeing apparatus 5. As depicted therein, the polychromatic yarn dying apparatus 5 is comprised of a upper track portion 20 and a lower track portion 60 which are in contact with each other in a determined section for dyeing, yarns 2 to be dyed being positioned between them, a plurality of dye supplying parts 100*a* to 100*d* contacting the lower surface of the lower track portion 60 and supplying different colors of dyes to the lower track portion 60, and a frame 19 supporting the upper track, portion 20, the lower track portion 60 and the dye supplying parts 100*a* to 100*d*.

The upper track portion 20 includes a pair of upper shafts 21 rotatably positioned in parallel and positioned transversely relative to the advancing direction of the yarns 2 to be dyed. A pair of upper wheels 27 are oppositely coupled with each of the upper shafts 21. An upper caterpillar unit 29 rotates around the upper wheels 27.

The lower track portion 60 includes first and second pairs of lower shafts 61 and 62 rotatably disposed parallel to the upper shafts 21. The second lower shafts 62 are positioned under the first lower shafts 61. First and second pairs of lower wheels 65 and 66 are oppositely coupled with the lower shafts 61 and 62, respectively. A lower caterpillar unit 67 rotates around the lower wheels 65 and 66.

The dye supplying parts 100*a* to 100*d* are respectively comprised of a dye reservoir 101 for containing dyestuff, a dye belt 103 with at least one portion dipped in the dye reservoir 101 and supplying the dyestuff with the lower caterpillar unit 67 by contact therewith, and a plurality of dye rollers 105 and 106 positioned inside of the dye belt 103 to support rotation of the dye belt 103.

In the upper part of the frame 19 are disposed the pair of upper shafts 21 parallel to each other. At both ends of each of the upper shafts 21, bearing members 23 are installed so as to support the rotation of the upper shafts 21 relative to the frame 19. A driving gear 25 is coupled to one side of one upper shaft 21 so as to-receive a driving force from the outside. On opposite sides of each of the upper shafts 21 are also disposed the pair of upper wheels 27 so as to be rotated together with the upper shafts 21. Each upper wheel 27 comprises a sprocket wheel having numbers of teeth formed on the circumference thereof. The upper wheels 27 transmits the rotation to the upper caterpillar unit 29.

The upper caterpillar unit 29 is comprised of a pair of upper chains 31 engaged with the respective upper wheels 27 in the advancing direction of the yams, a plurality of chain brackets 33 taking the shape of "L," extending inward from the inner portions of the upper chains. 31, and a plurality of upper dyeing member supports 35 connecting the opposite chain brackets 33 spaced from each other along the axial direction of the upper shafts 21.

Figure 5:
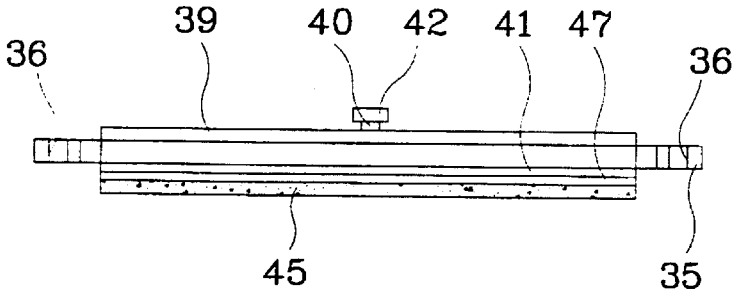
FIG. 5 is an enlarged view showing an assembled state of an upper dyeing member and an upper dyeing member support of FIG. 3.
Figure 6:
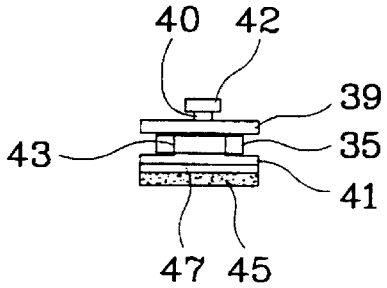
FIG. 6 is a side sectional view of the assembly in FIG. 5.
Figure 7:
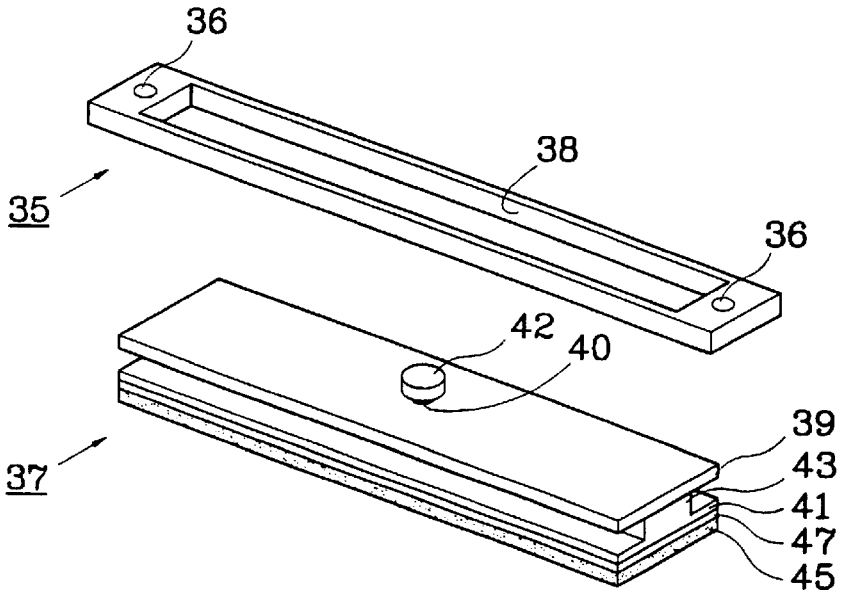
FIG. 7 is an exploded perspective view of the assembly in FIG. 5.

Referring to FIGS. 5 through 7, an upper dyeing member 37 is coupled to the upper dyeing member support 35 so as to move in a lengthwise direction of the support 35. On one surface of each upper dyeing member 37 is provided a roller pin 40, and on each roller pin 40 is provided a roller 42 rotating relative to the roller pin 40. These rollers 42 are disposed on the inside of the upper caterpillar unit 29 along the advancing direction of the yarns 2, and are engaged and guided within a rail recess 54 of an oscillation guide part 49 having a path of approximately "S-shape" (see FIG. 8).

The lower track portion 60 is in contact with the upper track portion 20, with yarns 2 to be dyed being positioned between them, thereby creating a section for dyeing the yarns 2. The lower track portion 60 includes the pair of first lower shafts 61 disposed corresponding with the upper shafts 21 under the upper shafts 21, and the pair of second lower shafts 62 disposed under the first lower shafts 61. The first and second lower wheels 65 and 66 formed with sprocket are disposed in each of the first and second lower shafts 61 and 62 spaced from each other so that they can be rotated integrally with the lower shafts. The second lower shafts 62 are positioned in the front and rear of the first lower shafts 61 along the advancing direction of the yarns 2. Accordingly, the lower caterpillar unit 67 rotatably engaging the lower wheels 65 and 66 approximately takes a shape of trapezoid.

The first lower shaft 61 of the lower caterpillar unit 67 is coupled to a driven gear 63 which is then engaged with the driving gear 25 laterally coupled to the upper shaft 21. The driven gear 63 is constructed with the same shape and teeth as the driving gear 25. With this construction, the lower caterpillar unit 67 is rotated with the same speed as that of the upper caterpillar unit 29 in the opposite direction. Herein, to synchronize the speeds of the upper caterpillar unit 29 and the lower caterpillar unit 67, other driving means such as chain drive may be used.

The lower caterpillar unit 67 is comprised of a pair of lower chains 69 coupled to the lower wheels 65 and 66, chain brackets 71 taking a shape of "L," extending from the opposite in sides of the lower chains 69, a lower dyeing member support 73 connecting the pair of chain brackets 71 spaced with each other along the axial direction of the lower shafts 61 and 62. A lower dyeing member 77 is coupled to each of the dyeing member supports 73 so that the dyeing member 77 can be elevated or withdrawn almost vertically relative to the support 73 (see FIGS. 11 through 13).

Press rollers 78*a* to 78*d* having a rotary shaft parallel to the lower shafts are rotatably coupled to the lower dyeing member 77. Above the press rollers 78*a* to 78*d* are disposed a plurality of press members 87*a* to 87*d* along the advancing direction of the lower caterpillar unit 67 to press the respective press rollers 78*a* to 78*d* so that the lower dyeing member 77 protrudes downward from each of the dyeing member supports 73. Their construction and operation will be described later.

Under the lower caterpillar unit 67 are disposed the plurality of dye supplying parts 100*a* to 100*d* along the advancing direction of the lower caterpillar unit 67. The dye supplying parts 100*a* to 100*d* supply dyestuff to the lower dyeing members 77 by contacting with the lower dyeing members 77 of the unit 67. Inside of the dye reservoir 101 of each of dye supplying parts 100*a* to 100*d* are provided the plurality of dye rollers 105 and 106 having rotary shafts disposed parallel to the second lower shaft 62. Each of the dye rollers 105 and 106 is coupled to the dye belt 103 for supplying dyestuff, at least a part of which is dipped in the dye reservoir 101.

Figure 4:
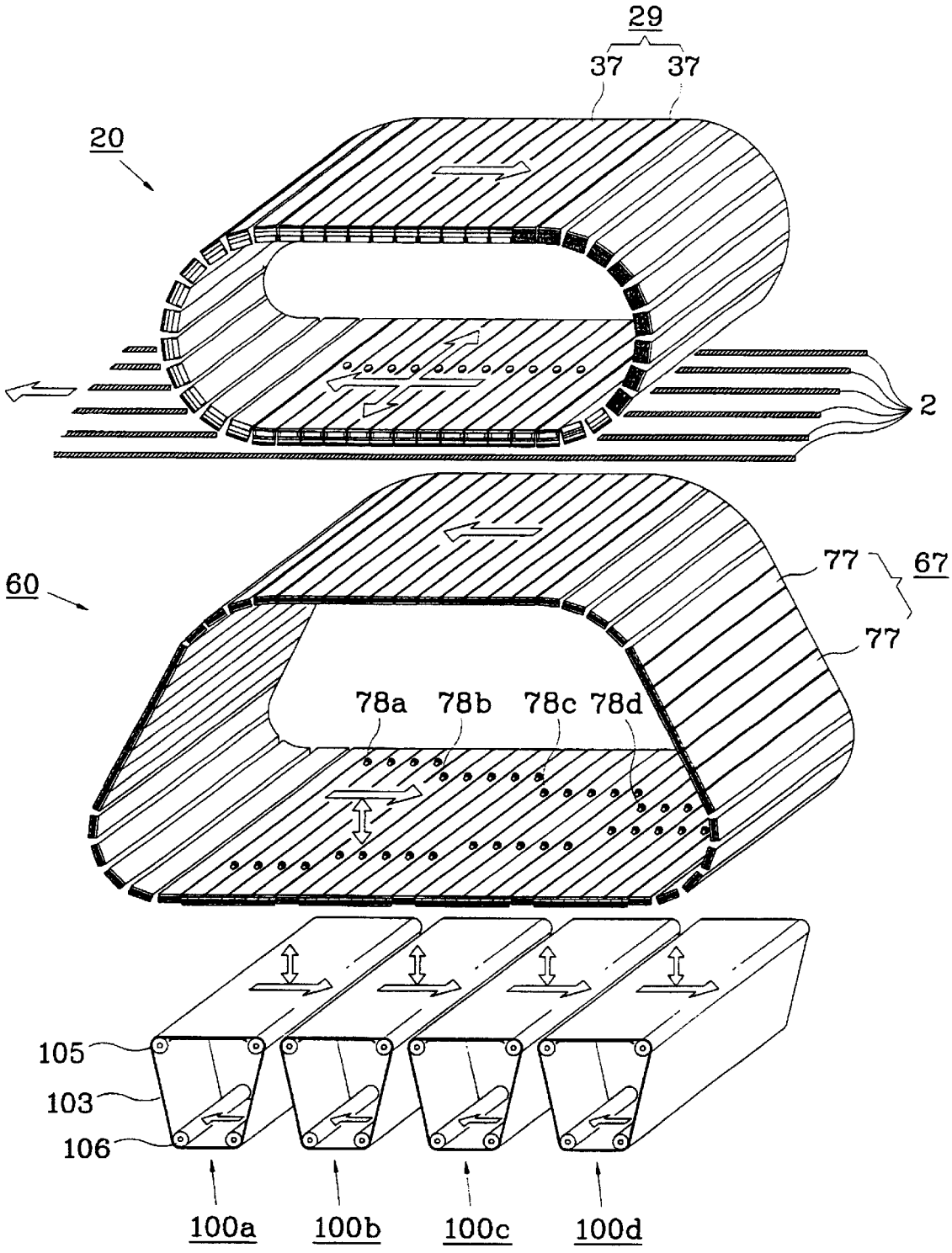
FIG. 4 schematically shows an operation of the polychromatic yarn dyeing apparatus of FIGS. 2 and 3.

FIG. 4 schematically shows an operation of the polychromatic yam dyeing apparatus 5 according to the present embodiment. Referring to FIG. 4, the operation of the polychromatic yam dyeing apparatus 5 will be described schematically. Yarns to be dyed are arranged being spaced apart from each other between the upper track portion 20 and the lower track portion 60. The upper track portion 20 and the lower track portion 60 are rotated opposite, to each other with the same speed. The upper dyeing members 37 and the lower dyeing members 77 are contacted, with the yarns 2 being positioned therebetween. The upper dyeing members 37 oscillate transversely to the advancing direction of the upper caterpillar unit 29 to roll the yarns 2 relative to the lower dyeing members 77, thereby enabling the dyestuff supplied through the lower dyeing members 77 to be permeated into tissues of the yarns 2 evenly.

After conducting the dyeing while contacting the upper dyeing members 37, the lower dyeing members 77 move downward to contact the dye, supplying parts 100*a* to 100*d*. The lower dyeing members 77 protrude downward after arriving at the respective dye supplying parts 100*a* to 100*d*, to contact the dye belt 103 so that the dyestuff is supplied thereto. After the dyestuff is supplied thereto, the lower dyeing members 77 move upward to contact the upper dyeing members 37 and conduct again the dyeing.

Referring to the accompanying drawing's again, the polychromatic yarn dyeing apparatus according to the present embodiment will be described in more detail in light of construction.

FIG. 5 is an enlarged view showing an assembled state of the upper dyeing member 37 and the dyeing member support 35 of FIG. 3, FIG. 6 is a side sectional view of the assembly in FIG. 5, and FIG. 7 is an exploded perspective view of the assembly in FIG. 5. As shown, the upper dyeing member support 35 is formed with a long plate member, the ends of which are formed with coupling holes 36 for coupling to the chain brackets 33. In the central portion thereof, a receiving slit 38 is provided along the longitudinal direction of the member 35. The upper dyeing member 37 is engaged in the receiving slit 38 to move in the lengthwise direction of the slit 38.

The upper dyeing member 37 is comprised of an upper plate 39, a lower plate 41 and an upper dye pad 45 coupled to the bottom of the lower plate 41. The upper dyeing member support 35 is positioned between the upper plate 39 and the lower plate 41 parallel to each other. The upper dye pad 45 and a lower dye pad to be described later are, respectively constructed to have a minimum unit width for a desired color and a suitable length for the number of yarns to be dyed and the space between yams. On the lower plate 41 is formed a sliding part 43 protruding toward the upper plate 39 and extending along the longitudinal direction thereof. The sliding part 43 is so wide and thick as to have a tolerance to slide within the receiving slit 38. The length of the sliding part 43 is such that the upper dyeing member 37 can move along the longitudinal direction of the receiving slit 38 by a predetermined distance. The upper plate 39 is fixed to the end of the sliding part 43 passing through the receiving slit 38. As described above, the roller pin 40 protrudes from the upper surface of the upper plate 39 and the roller 42 is rotatably coupled to the end of the roller pin 40.

An upper dye pad fixing plate 47 for fixing the upper dye pad 45 is detachably coupled to the bottom surface of the lower plate 41. The upper dye pad 45 is formed of a spongy member which has superior process ability, dye-absorbability and ability for maintaining the shape when absorbing the dyestuff. Desirably, such spongy member is made from synthetic fiber, synthetic rubber, synthetic resin or nonwoven fabric.

Figure 8:
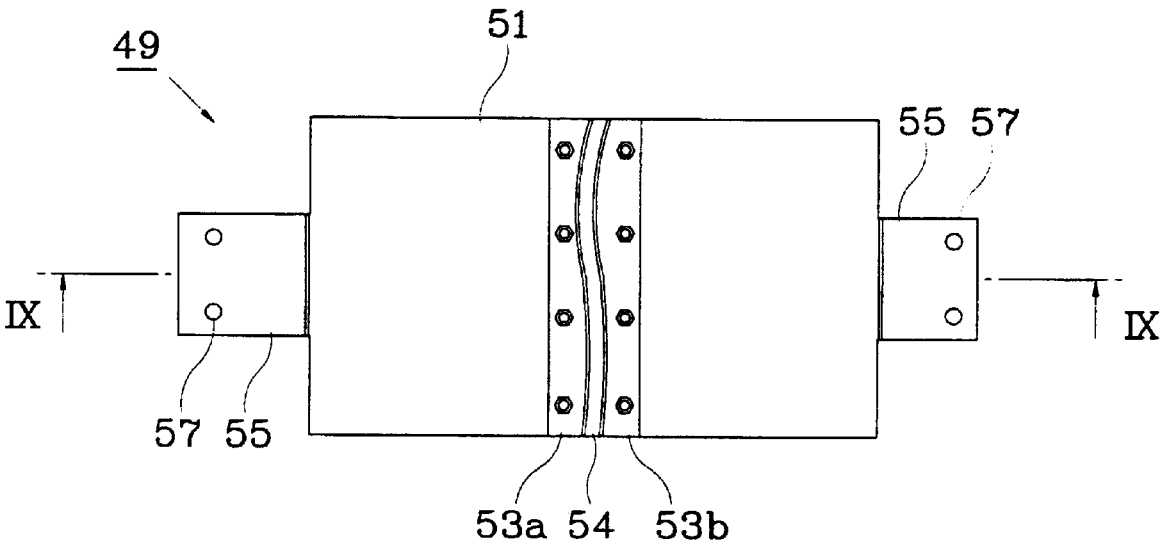
FIG. 8 is a fragmentary top plan view of an oscillation guide part of FIG. 3.
Figure 9:
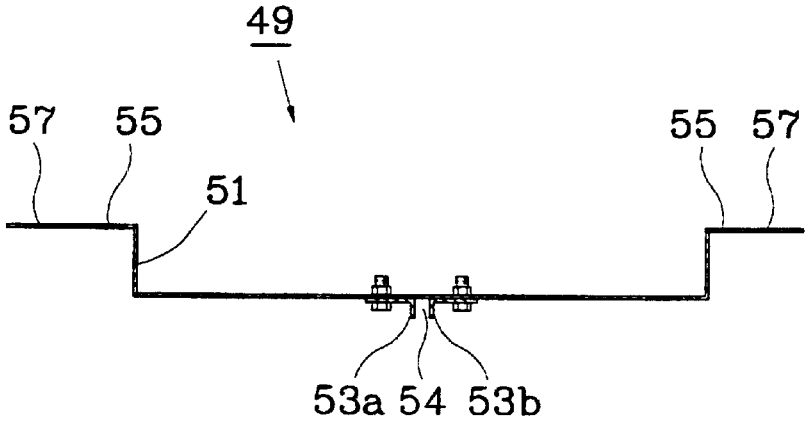
FIG. 9 is a sectional view of the oscillation guide part, taken along line of IX—IX of FIG. 8.

FIG. 8 is a fragmentary top plan view of an oscillation guide part 49 of FIG. 3, and FIG. 9 is a sectional-view of the oscillation guide part 49 taken along line of IX—IX of FIG. 8. As illustrated therein, the oscillation guide part 49 is comprised of oscillation guide rails 53*a* and 53*b* forming a rail recess 54 having a shape of approximately "S," disposed in parallel in the advancing direction of the yarns inside of the lower part of the upper caterpillar unit 29, and a rail support 51 for supporting the guide rails 53*a* and 53*b*. The rail support 51 takes a section of approximately "U." At both edges of the rail support 51 are formed fixing flanges 55 extending outwardly. Each fixing flange 55 has holes 57 formed therethrough for fixing the rail support 51 to the frame 19. The oscillation guide rails 53*a* and 53*b* coupled to the bottom surface of the rail support member 51 has a section of approximately "L."

Figure 10:
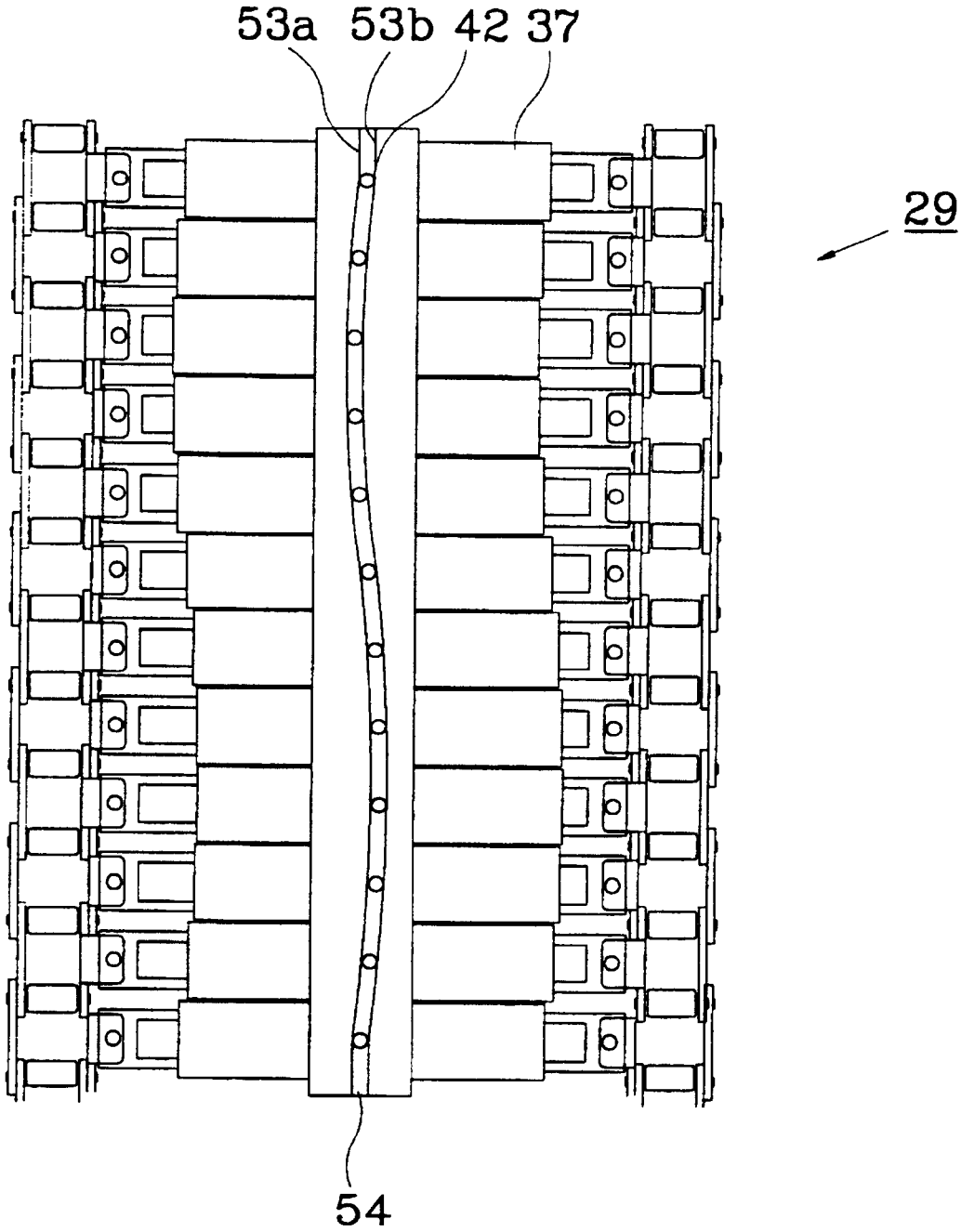
FIG. 10 is a fragmentary top plan view showing an oscillating state of the upper dyeing member of FIG. 3.

FIG. 10 is a fragmentary top plan view showing an oscillating state of the upper dyeing members 37 of FIG. 3. As depicted, if the upper caterpillar unit 29 is rotated, the roller 42 rotatably coupled to the upper side of each of the upper dyeing members 37 are received in the rail recess 54 formed between the roller guide rails 53*a* and 53*b*. The rollers 52 received within the rail recess 54 move forwardly with the movement speed of the upper caterpillar unit 29 and at the same time rollably contact the roller guide rails 53*a* and 53*b*, and then roll transversely to the advancing direction of the upper caterpillar unit 29 along the S-shaped rail recess 54.

Figure 11:
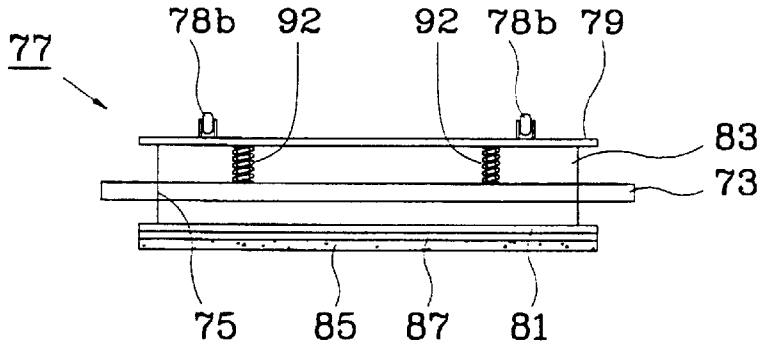
FIGS. 11 and 12 are enlarged views showing respectively elevation and withdrawal of a lower dyeing member of FIG. 3.
Figure 12:
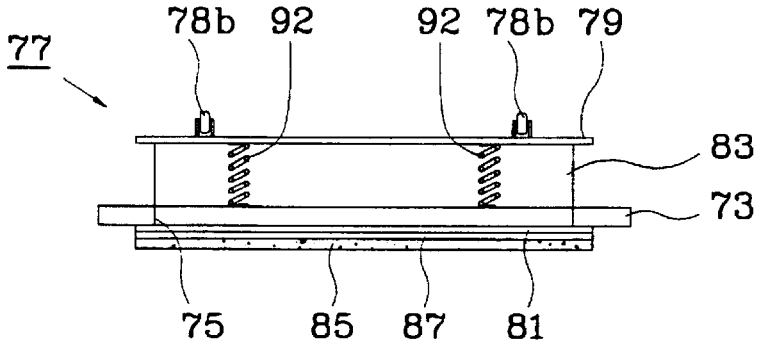
Figure 13:
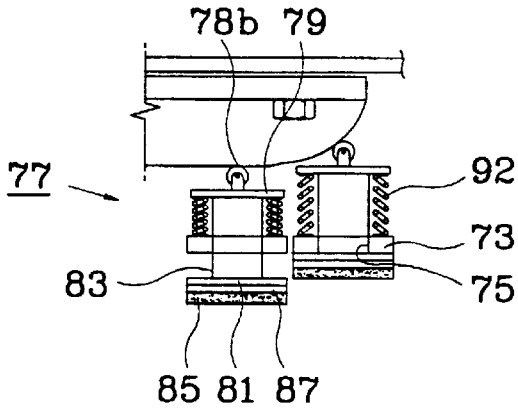
FIG. 13 shows a comparison of the elevation of the lower dyeing member with the withdrawal thereof.

FIGS. 11 and 12 are enlarged views showing respectively elevation and withdrawal of the lower dyeing member 77 of FIG. 3, and FIG. 13 shows a comparison of the elevation of the lower dyeing member 77 of FIGS. 11 and 12 with the withdrawal thereof. Referring to these drawings, the lower dyeing member 77 is comprised of an upper plate 79, a lower plate 81, a sliding part 83 and a lower dye pad 85, which are disposed in parallel in sequence. The lower dyeing member support 73 is positioned between the upper plate 79 and the lower plate 81. The sliding part 83 passes through the lower dyeing member support 73, so as to be elevated. The lower dyeing pad 85 is coupled to the outer surface of the lower plate 81. A slit 75 is formed through the lower dyeing member support 73. The sliding part 83 has a tolerance for sliding through the slit 75.

As described above, the lower dye pad fixing plate 87 for fixing the lower dye pad 85 is detachably coupled to the bottom surface of the lower plate 81. The lower dye pad 85 is formed of a spongy member which has superior process ability, dye-absorbability and ability for maintaining the shape when absorbing the dyestuff. Desirably, such spongy member is made from synthetic fiber, synthetic rubber, synthetic resin or nonwoven fabric.

On the outer surface of the upper plate 79 are disposed the pair of press-rollers 78*b* which have rotary shafts disposed in parallel to the lower shafts 61 and 62. The pair of press rollers 78*b* are disposed so as to be spaced with the same interval as the press members 87*b* corresponding to the dye supplying part 100*b*. Accordingly, the rollers 78*b* become in contact with the press members 87*b* when the rollers 78*b* reach the dye supplying part 100*b* during the course of operation, so that the rollers 78*b* protrude downwardly from the lower dyeing member support 73, as illustrated in FIGS. 11 and 13.

A plurality of springs 92 are disposed between the lower dyeing member support 73 and the upper plate 79. The springs 92 enable the lower dyeing member 77 which is protruded downward by contacting with the press member 87*b* which elastically- presses the upper plate 79 relative to the lower dyeing member support 73 to return to the original state.

Figure 14:
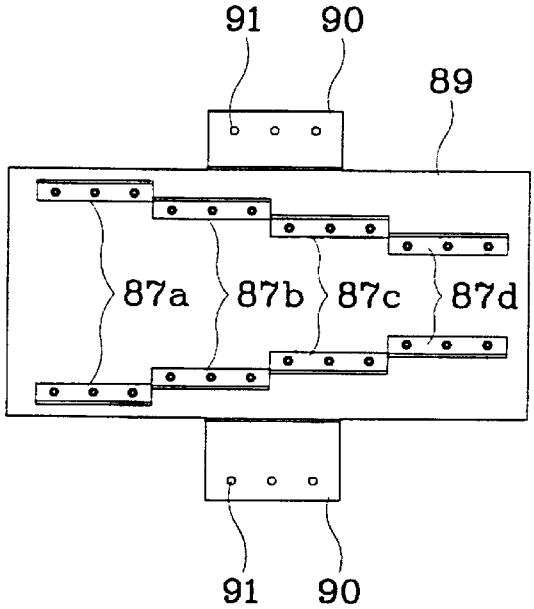
FIG. 14 is an enlarged top plan view of the press members of FIG. 3.
Figure 15:
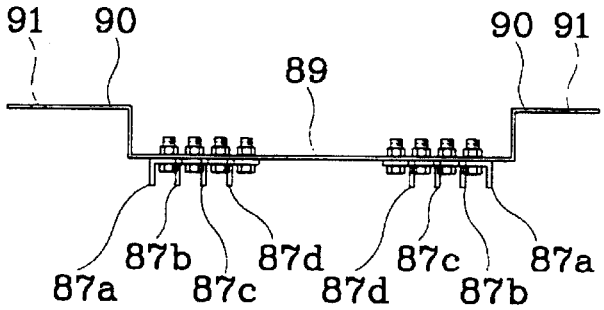
FIG. 15 is a side sectional view of the press members in FIG. 14.
Figure 16:
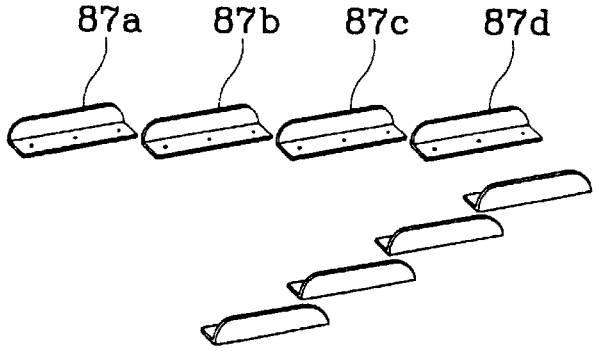
FIG. 16 is a perspective view of the press members of FIG. 14 as arranged.

FIG. 14 is an enlarged top plan view of the press members of FIG. 3, FIG. 15 is a side sectional view of the press members of FIG. 14, and FIG. 16 is an enlarged perspective view of the press members of FIG. 14 as arranged. As shown, a press member support 89 having a section of approximately "U" is installed to the frame 19 in the advancing direction of the lower caterpillar unit 67. The press member support 89 is located inside of the lower caterpillar unit 67 within the dye supply section. At both edges of-the press member support 89 are formed fixing flanges 90 outwardly, for fixing the support 89 to the frame 19. The fixing flanges 90 have respectively a plurality of bolt holes 91, through which bolts (not shown) are coupled to the frame 19.

On the bottom surface of the press member support 89 are disposed plural pairs of the press members 87*a* to 87*d* with predetermined distances therebetween corresponding to the dye support parts 100*a* to 100*d*. Each of the press members 87*a* to 87*d* has a section of approximately "L." The distance between each pair of the press members 87*a* to 87*d* corresponds to the distance between each pair of press rollers 78*a* to 78*d*. Both ends of each of the press members. 87*a* to 87*d* in the longitudinal direction are rounded so that they smoothly contact with the press rollers 78*a* to 78*d*. As described with reference to FIGS. 11 to 13, the press members 87*a* to 87*d*press their respective rollers 78*a* to 78*d* to protrude their corresponding lower dyeing member 77 downwardly, so that dyestuff from the corresponding dye support part is supplied to the lower dyeing member 77.

Figure 17:
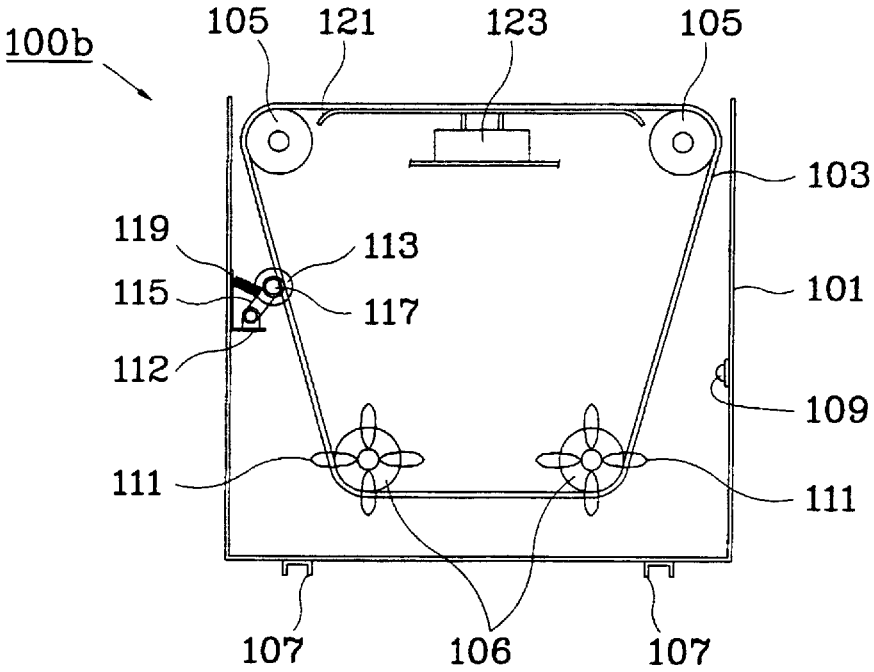
FIG. 17 is an enlarged view of a dye supplying part of FIG. 2.
Figure 18:
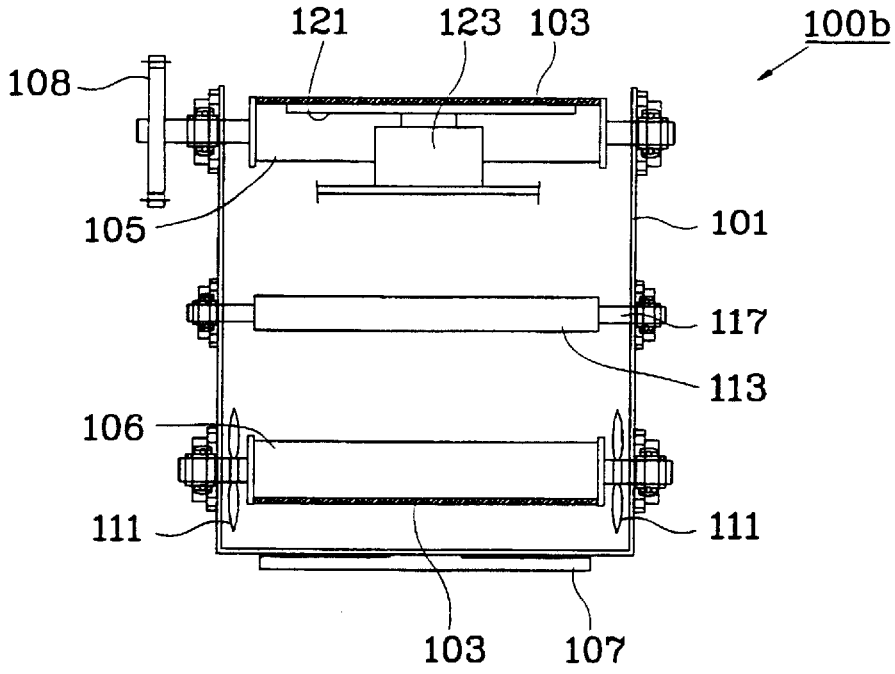
FIG. 18 is a longitudinal sectional view of the dye supplying part of FIG. 17.

FIG. 17 is an enlarged view of the dye supplying part of FIG. 2, and FIG. 18 is a sectional view of the dye supplying part of FIG. 17. As depicted and described above, the dye supplying part 100*b* is disposed under the lower caterpillar unit 67 along the advancing direction of the lower caterpillar unit 67, and has the dye reservoir 101 containing dyestuff, the plurality of upper and lower dye rollers 105 and rollers 106, and the dye belt 103. The upper and lower dye rollers 105 and 106 are rollably installed at rotary shafts which are disposed in parallel with the lower shafts 61 and 62 in the upper and lower parts of the dye reservoir 101. The dye belt 103 supplies dyestuff to the lower dyeing pad 85 by travelling around the dye rollers 105 and 106 and contacting with the lower dye pad 85 in a predetermined dyeing section.

A dye gear 108 is coupled to one side of the rotary shaft of the upper dye roller 105 disposed in the upper part of the dye reservoir 101 to transmit a driving force from the outside to the dye roller 105. Preferably, the upper dye roller 105 and the dye belt 103 are engaged with each other by complementary grooves and protrusions formed thereon so as to prevent slippage therebetween. A spongy member (not shown) is provided on the outer surface of the dye belt 103, so as to easily absorb dyestuff. Desirably, such spongy member is made from synthetic fiber, synthetic rubber, synthetic resin or nonwoven fabric.

A rail member 107 is provided on the bottom surface of the dye reservoir 101, for guiding the dye reservoir 101 so as to be correctly positioned under the lower caterpillar unit 67. A dye level sensor 109 is provided inside of the dye reservoir 101 so as to detect the level of the dye in the dye reservoir 101.

A plurality of blades 111 are coupled to opposite ends of the rotary shafts of each lower dye roller 106, for rotating with the rotary shafts so as to stir dyestuff in the reservoir. Beside an ascending part of the dye belt 103 is installed a dye control roller 113 for controlling the amount of the dyestuff absorbed into the dye belt 103 by elastically contacting with the dye belt 103.

A rotary shaft 117 of the dye control roller 113 is supported by a rotary support 115, one end of which is rotatably supported in the fixing bracket 113 fixedly coupled to a wall of the dye reservoir 101. A spring member 1199 is coupled between the wall of the dye reservoir 101 and the rotary support 115 so as to elastically contact the dye control roller 113 with the dye belt 103.

In the upper portion of the dye reservoir 101 is a belt guide member 121 disposed along the advancing direction of the lower caterpillar unit 67. The belt guide member 121 functions to prevent the dye belt 103 from drooping or sagging when it contacts the lower dye pad 85, and at the same time to guide the dye belt 103 absorbing the dyestuff. Under the belt guide member 121 is disposed a vibrating device 123 for vibrating the belt guide member 121 vertically.

With this configuration, the upper track portion 20 and the lower track portion 60 are rotated oppositely with the same speed by the engagement of the driving gear 25 and the driven gear 63 which have the same dimensions. The lower dye pads 85 absorb the dye while passing through the dye support parts 100*a* to 100*d*, and contact with the upper dye pads 45 while moving at the same speed with the yarns 2 placed therebetween. The roller 42 protruding from the upper dyeing member 37 is received within the rail recess 54 formed by the oscillation guide rails 53*a* and 53*b* and moves along the curved line of S-shape. Thus, the upper dye pads 45 move transversely relative to the advancing direction of the upper caterpillar unit 29 against the lower dye pads 85. The yarns 2 disposed between the upper dye pads 45 and the lower dye pads 85 are rolled laterally along the upper dye pad 45, thereby absorbing the dye evenly into the tissues of the yarns 2.

The lower dye pad 85 passing through the dyeing section moves to the dye supplying parts 100*a* to 100*d* disposed under the lower track portion 60, and contacts with the press rollers 78*a* to 78*d* of the press members 87*a* to 87*d* corresponding to their respective dye supplying parts 100*a* to 100*d*, thereby protruding downwardly. By the downward protrusion, the lower dye pads 85 are in contact with the dye belt 103 absorbing the dye, thereby receiving the dye from the dye belt 103. The dye is evenly and smoothly supplied into the lower dye pad 85 because the vibrating devices 123 in the dye supplying parts 100*a* to 100*d* vibrate the dye belt 103 vertically.

The lower dye pad 85 after passing through the dye supplying parts 100*a* to 100*d* is withdrawn from the dye belt 103 by the spring 92 and moves to the dyeing section. The dyeing is performed by repetitive processes for contacting with the upper dyeing member 37, with the yarns 2 to be dyed being positioned therebetween.

In the embodiment described above and illustrated in the accompanying drawings, the curved rail recess 54 is provided above the upper dyeing member 37 and the roller 42 engaging with the rail recess 54 is provided to the upper dyeing member 37 so as to oscillate the upper dyeing member 37 transversely. However, the oscillation can be accomplished, using a construction disclosed in Korean Patent Publication No. 97-313.

Alternatively, a cam profile of S-curve may be provided along the passage of the upper dyeing member 37, instead of the rail recess 54. In this case, a protrusion or a roller (not shown) is provided at one side of the upper dyeing member 37 and a spring (not shown) is provided at the other side of the upper dyeing member 37. Thus, the lower dyeing member 37 can move laterally while the protrusion or roller moves along the cam profile.

In the embodiment described above and illustrated in the accompanying drawings, the distances between each pair of press rollers 78*a* to 78*d* and press members 87*a* to 87*d* are fixed. However, the distances can be adjusted by forming elongated slots for movement in the fixing part thereof.

In the embodiments described above and illustrated in the accompanying drawings, four dye supplying parts are disposed. However, the number of dye supplying parts will vary, depending upon the dyeing pattern.

As described above, the polychromatic yam dyeing apparatus according to the present invention is advantageous in decreasing a space for installation and conducting continuous and repetitive dyeing operations with a unit pattern having predetermined color, width and arrangement.

It will be appreciated by those skilled in the art that various modifications and changes may be made without departing from the scope of the invention, and all such modifications and changes are intended for fall within the scope of the invention, as defined by the appended claims.

What is claimed is:

1. A polychromatic yarn dyeing apparatus comprising:

an upper track portion having at least one pair of upper wheels disposed in parallel, an upper caterpillar unit rotatably travelling around the upper wheels in a traveling direction, and a plurality of upper dyeing members coupled with the upper caterpillar unit;

a lower track portion having at least one pair of lower wheels disposed in parallel, a lower caterpillar unit rotatably travelling around the lower wheels at the same travelling speed as that of the upper caterpillar unit in a traveling direction and having a travelling section parallel to and moving in an advancing direction with a travelling section of the upper caterpillar unit, and a plurality of lower dyeing members coupled with the lower caterpillar unit, the lower dyeing members contacting the upper dyeing members along the traveling section with a yarn being positioned therebetween; and a plurality of dye supplying parts disposed sequentially along the travelling direction of the lower caterpillar unit, for supplying dyestuff of different colors respectively to preselected ones of the lower dyeing members such that the preselected ones of the lower dyeing members supplied with respective different color dyestuffs travel to the traveling section of the lower caterpillar unit for engagement with the traveling section of the upper caterpillar unit to transfer the associated different color dyestuffs to the yarn located therebetween.

2. The apparatus according to claim 1, further comprising an elevating unit for elevating the preselected ones of the lower dyeing members toward the corresponding dye supplying parts so as to contact the preselected ones of the lower dyeing members with the different color dyestuff in the respective dye supplying parts.

3. The apparatus according to claim 2, wherein the elevating unit comprises:

a respective lower dyeing member support for supporting each respective one of the lower dying members;

a plurality of respective press members provided inside a lower section of the lower caterpillar unit along the traveling direction of the lower caterpillar unit in correspondence to the respective dye supplying parts;

a respective press roller protruding from each of the preselected ones of the lower dyeing members for contacting the respective press members to press the respective lower dyeing members against the respective dye supplying parts; and a respective spring disposed between each respective lower dyeing member support and each lower dyeing member associated therewith, for elastically recovering the respective pressed lower dyeing member from a state of being pressed against the respective dye supplying part to an original state.

4. The apparatus according to claim 1, further comprising an oscillating unit for oscillating the upper dyeing members in the traveling section thereof in a transverse direction relative to the advancing direction of the upper caterpillar unit.

5. The apparatus according to claim 4, wherein the oscillating unit comprises:

a respective upper dyeing member support for supporting each respective one of the upper dyeing members;

an oscillation guide part forming a passage of S-type inside a lower section of the upper caterpillar unit along the advancing direction of the traveling section of the upper caterpillar unit; and a respective sliding part protruding from each respective upper dyeing member and slidably guided by the oscillation guide part.

6. The apparatus according to claim 1, wherein each of the dye supplying parts comprises:

a dye reservoir for containing the dyestuff;

a dye belt forming a closed loop and having a portion dipped in the dye reservoir to contact the dyestuff and an upper section contacting with the lower dyeing members of the lower caterpillar unit; and a dye belt driving unit for driving the dye belt in an opposite direction to the traveling direction the lower caterpillar unit.

7. The apparatus according to claim 6, further comprising, for each dye supplying part, a dye belt vibrating unit for vibrating the dye belt in a vertical direction relative to an advancing direction of the dye belt.

8. The apparatus according to claim 6, further comprising, for each dye supplying part, a dye controlling unit in contact with a portion of the dye belt ascending out of the dye reservoir for controlling an amount of dyestuff absorbed in the dye belt.

9. The apparatus according to claim 6, further comprising, for each dye supplying part, an agitating unit for agitating the dyestuff contained within the dye reservoir.

10. A polychromatic yarn dyeing apparatus comprising:

an upper track portion having at least one pair of upper wheels disposed in parallel, an upper caterpillar unit rotatably travelling around the upper wheels in a traveling direction, and a plurality of upper dyeing members coupled with the upper caterpillar unit;

a lower track portion having at least one pair of lower wheels disposed in parallel, a lower caterpillar unit rotatably travelling around the lower wheels at the same travelling speed as that of the upper caterpillar unit in a traveling direction and having a travelling section parallel to and moving in an advancing direction with a travelling section of the upper caterpillar unit, and a plurality of lower dyeing members coupled with the lower caterpillar unit, the lower dyeing members contacting the upper dyeing members along the traveling section with a yarn being positioned therebetween;

a plurality of dye supplying parts disposed sequentially along the travelling direction of the lower caterpillar unit, for supplying dyestuff of different colors respectively to the lower dyeing members; and an oscillating unit for oscillating the upper dyeing members in the traveling section thereof in a transverse direction relative to the advancing direction of the upper caterpillar unit.

11. The apparatus according to claim 10, further comprising an elevating unit for elevating the lower dyeing members toward the corresponding dye supplying parts so as to contact the lower dyeing members with the dyestuff in the respective dye supplying parts.

12. The apparatus according to claim 11, wherein the elevating unit comprises:

a respective lower dyeing member support for supporting each respective one of the lower dying members;

a plurality of respective press members provided inside a lower section of the lower caterpillar unit along the traveling direction of the lower caterpillar unit in correspondence to the respective dye supplying parts;

a respective press roller protruding from each of the lower dyeing members for contacting the respective press members to press the respective lower dyeing members against the respective dye supplying parts; and a respective spring disposed between each respective lower dyeing member support and each lower dyeing member associated therewith, for elastically recovering the respective pressed lower dyeing member from a state of being pressed against the respective dye supplying part to an original state.

13. The apparatus according to claim 10, wherein the oscillating unit comprises:

a respective upper dyeing member support for supporting each respective one of the upper dyeing members;

an oscillation guide part forming a passage of S-type inside a lower section of the upper caterpillar unit along the advancing direction of the traveling section of the upper caterpillar unit; and a respective sliding part protruding from each respective upper dyeing member and slidably guided by the oscillation guide part.

14. The apparatus according to claim 10, wherein each of the dye supplying parts comprises:

a dye reservoir for containing the dyestuff;

a dye belt forming a closed loop and having a portion dipped in the dye reservoir to contact the dyestuff and an upper section contacting with the lower dyeing members of the lower caterpillar unit; and a dye belt driving unit for driving the dye belt in an opposite direction to the traveling direction the lower caterpillar unit.

15. The apparatus according to claim 14, further comprising, for each dye supplying part, a dye belt vibrating unit for vibrating the dye belt in a vertical direction relative to an advancing direction of the dye belt.

16. The apparatus according to claim 14, further comprising, for each dye supplying part, a dye controlling unit in contact with a portion of the dye belt ascending out of the dye reservoir for controlling an amount of dyestuff absorbed in the dye belt.

17. The apparatus according to claim 14, further comprising, for each dye supplying part, an agitating unit for agitating the dyestuff contained within the dye reservoir.

18. A polychromatic yarn dyeing apparatus comprising:

an upper track portion having at least one pair of upper wheels disposed in parallel, an upper caterpillar unit rotatably travelling around the upper wheels in a traveling direction, and a plurality of upper dyeing members coupled with the upper caterpillar unit;

a lower track portion having at least one pair of lower wheels disposed in parallel, a lower caterpillar unit rotatably travelling around the lower wheels at the same travelling speed as that of the upper caterpillar unit in a traveling direction and having a travelling section parallel to and moving in an advancing direction with a travelling section of the upper caterpillar unit, and a plurality of lower dyeing members coupled with the lower caterpillar unit, the lower dyeing members contacting the upper dyeing members along the traveling section with a yarn being positioned therebetween; and a plurality of dye supplying parts disposed sequentially along the travelling direction of the lower caterpillar unit, for supplying dyestuff of different colors respectively to the lower dyeing members, wherein each of the dye supplying parts comprises (a) a dye reservoir for containing the dyestuff, (b) a dye belt forming a closed loop and having a portion dipped in the dye reservoir to contact the dyestuff and an upper section contacting with the lower dyeing members of the lower caterpillar unit, and (c) a dye belt driving unit for driving the dye belt in an opposite direction to the traveling direction the lower caterpillar unit.

19. The apparatus according to claim 18, further comprising an elevating unit for elevating the lower dyeing members toward the corresponding dye supplying parts so as to contact the lower dyeing members with the dyestuff in the respective dye supplying parts.

20. The apparatus according to claim 19, wherein the elevating unit comprises:

a respective lower dyeing member support for supporting each respective one of the lower dying members;

a plurality of respective press members provided inside a lower section of the lower caterpillar unit along the traveling direction of the lower caterpillar unit in correspondence to the respective dye supplying parts;

a respective press roller protruding from each of the lower dyeing members for contacting the respective press members to press the respective lower dyeing members against the respective dye supplying parts; and a respective spring disposed between each respective lower dyeing member support and each lower dyeing member associated therewith, for elastically recovering the respective pressed lower dyeing member from a state of being pressed against the respective dye supplying part to an original state.

21. The apparatus according to claim 18, further comprising, for each dye supplying part, a dye belt vibrating unit for vibrating the dye belt in a vertical direction relative to an advancing direction of the dye belt.

22. The apparatus according to claim 18, further comprising, for each dye supplying part, a dye controlling unit in contact with a portion of the dye belt ascending out of the dye reservoir for controlling an amount of dyestuff absorbed in the dye belt.

23. The apparatus according to claim 18, further comprising, for each dye supplying part, an agitating unit for agitating the dyestuff contained within the dye reservoir.

* * * * *